United States Patent [19]

Tiebout, III

[11] 4,389,917

[45] Jun. 28, 1983

[54] VIOLIN AND VIOLA BRIDGE

[76] Inventor: Ralph H. Tiebout, III, 2527 Hyler Ave., Los Angeles, Calif. 90041

[21] Appl. No.: 286,580

[22] Filed: Jul. 24, 1981

[51] Int. Cl.[3] ..... G10D 3/04

[52] U.S. Cl. ..... 84/309; 84/307

[58] Field of Search ..... 84/274–283, 84/307, 309–311

[56] References Cited

U.S. PATENT DOCUMENTS 1,356,439 10/1920 Fitt ..... 84/309
4,286,494 9/1981 Jauquith ..... 84/309

FOREIGN PATENT DOCUMENTS 117593 2/1901 Fed. Rep. of Germany ..... 84/309
128936 3/1902 Fed. Rep. of Germany ..... 84/309
736946 12/1932 France ..... 84/309

*Primary Examiner*—Lawrence R. Franklin
*Attorney, Agent, or Firm*—Thomas I. Rozsa

[57] ABSTRACT

An improved violin or viola bridge design which is capable of vastly increasing the amplification and transmission of the vibrations from the strings to the sounding box of the violin and further enables significant amounts of material from the bridge to be removed in order to accommodate numerous string height requirements for different violins. An improved material from which the bridge is constructed to create significant improvements in amplification and transmission of string vibrations to the sounding box and to increase the useful life of the bridge.

79 Claims, 9 Drawing Figures

VIOLIN AND VIOLA BRIDGE

BACKGROUND OF THE INVENTION

The violin represents a prime achievement in the evolution of string musical instruments which evolved from more primitive instruments such as the rebec and the lute. The modern day violin can be traced to at least as early as the sixteenth century where many violins were built under the supervision on Andrea Amati at the Cremona school of violin makers in Italy.

In essence, a violin is a set of strings mounted on a wooden box containing an almost closed air space. The wooden box or sounding box consists of a front plate also called the belly and a back plate also called the bottom. Both are arched slightly outward to form broad bell-like shapes. They are joined and supported by ribs or sides. The back plate is carved with chisel, plane and scraper, traditionally from a block of curly maple seasoned for at least ten (10) years and not kiln-dried. In thickness the back plate varies from about five millimeters in the center to almost two and a half millimeters just inside the edges. The sides are pieces of matching curly maple, thinned down to a millimeter all over, bent into shape and glued to spruce or willow blocks set in the corners and at the forward and rear ends of the plates.

The top plate, usually spruce, is split lengthwise from a log and then joined so that the wood of the outside of the tree is in the center of the top, making the grain bilaterally symmetrical. In thickness the top plate ranges from two to three and a half millimeters, and a pair of "f-holes" are cut into each side of the plate. All around the outside of each plate, near the edge, is cut a shallow groove in which is inlaid the "purfling", consisting usually of two strips of black-dyed pearwood and a strip of white poplar.

Attached at the upper portion of the sound box is the neck, which is usually made of curly maple. The fingerboard which lies over a portion of the neck and extends over the upper portion of the top plate is usually made of ebony. The tailpiece at the lower portion of the sounding board is usually made of rosewood or ebony.

The four violin strings, representing the musical notes G, D, A and E are strung so that they stretch over the neck and fingerboard and terminate at the forward edge of the tailpiece. The strings are supported across the center of the violin by the bridge. Traditionally, the bridge has been made of hard maple, such as spotted maple wood.

The combined tension of the four strings of a properly tuned violin comes to around 50 pounds. About 20 pounds is directed straight down through the bridge and against the sounding box. To distribute the load and help the top plate withstand the downward component of string tension, a strip of wood known as the bass bar is glued to the underside of the top plate; running lengthwise and located directly below the "G" string foot of the bridge. The bass bar is usually made of spruce.

To assist in transmitting musical vibrations from the top plate to the back plate, a vertical post is placed inside the sounding box. The post, called the sounding post, is held between the plates by friction and is located 5 to 6 millimeters below the "E" string foot of the bridge.

While violin making is an ancient art, few improvements have been made in the basic violin design since the days of the famous violin maker Antonio Stradivari. One of the most important and neglected elements of the violin has been the bridge.

In general, the bridge stands on the belly of the violin between the "f-holes" and is located so the bottom end of it is lined up with the inner nicks of the "f-holes." The bridge is not fastened to the violin body in any way, being merely kept in its place by the pressure of the four strings. One purpose of the bridge is to keep the strings at a playable height above the fingerboard.

The main purpose of the bridge is to transmit the vibrations of the strings to the belly and back of the violin. The bridge is the principal channel by which the vibrations of the strings pass to the top plate of the violin by way of the bass bar, and to the back plate of the violin by way of the sound post. In consequence of these important functions, the proportions of the bridge and its position on the top plate must be very carefully adjusted to the quality of the violin to which it is affixed. If the bridge is too thick, the vibrations of the strings will not pass with sufficient rapidity to the top plate. The height of the bridge must also be carefully adjusted to the instrument. If the bridge is to high, the tone will be dull and sluggish. If the bridge is too low, a harsh piercing tone will be the result.

The various styles of bridges produce different effects on a violin. The standard commercial style bridge is so stiff that is must be thinned greatly in order to work satisfactorily. If the bridge design is so rigid that it must be thinned greatly, it gains flexibility at the expense of force and strength. As a result, such a bridge does not properly transmit the vibration forces from the strings to the belly and bottom of the violin.

Under tension of the strings, the flexibility of the bridge is such that it amplifies the vibratory excitation of the strings. The bridge height varies from instrument to instrument. The higher the bridge, the greater the downward force on the bridge and the greater the force on the top and back of the bridge. The thinner the bridge, the more flexible it becomes. A significant problem arises with ordinary commercial bridges because they must be made very thin in order to flex at all. By the time the ordinary commercial bridge has been made thin enough for amplification of the string vibrations, the bridge is in serious danger of collapse or warping badly.

Although there have been many designs for violin bridges, most commercial designs are very similar to the design originally created by Antonio Stradivari. In order to work properly, the bridge must be made of spotted maple. The grain of the bridge must be horizontal and its proportions should be just half as thick at the top as at the feet. Such a bridge must be painstakingly made and suffers from the weaknesses described above. Furthermore, a violin bridge of such design and fabrication does not lend itself to easy mass production.

SUMMARY OF THE INVENTION

The present invention relates to an improved violin or viola bridge design which is capable of vastly increasing the amplification of the musical vibrations from the strings to the sounding box. Utilization of this improved violin bridge enables the musical qualities of the violin to be enhanced and the power of the instrument to be increased.

The present invention further relates to an improved violin or viola bridge which is capable of mass production while at the same time not losing any of the important characteristics which must be maintained in order to serve its function as the primary transmitter of vibrations from the strings to the belly and back of the violin.

The present invention also relates to an improved violin or viola bridge design which is capable of mass production while at the same time accommodating individual modification in size to fit any particular violin.

The present invention is based on the realization that the violin is a musical instrument whose parts can be understood best by thinking of them as a system of wooden springs adjusted to critical balance. The height of the bridge alters the tension of the strings when brought to pitch. The position of the sound post relative to the bridge and the bridge relative to the "f-holes" alters the response of the back and top plates to the agitation of the strings. The arching of the top and back relative to the individual outline alters their response to vibrations transmitted to them through the bridge and sound post. One force creates a counter-balancing force to produce tension at rest. When this "tension at rest" becomes critical, there exists the optimum condition for amplification and augmentation of the string vibrations when bowed. It is important to manufacture a violin bridge which can create this critical balance.

In physics, a "beat" frequency results when two frequencies cancel each other and give rise to a third. This principal is incorporated into the present invention. Under tension of the strings, the flexibility of the bridge is such that it amplifies the vibratory excitation of the strings. The higher the bridge, the greater downward force on the bridge and hence the top and back. This relates inversely to the thickness of the bridge. The thinner the bridge, the more flexible it becomes. As a result, bridges must be carefully fitted. The present invention relates to an improved violin or viola bridge which incorporates all of the above elements into its design so as to provide a bridge that yields the resonant flexibility required while at the same time providing sufficient strength.

The present invention further relates to a violin or viola bridge which is designed to compensate for differing heights. With the bridge thickness adjusted to be from 1/16 inch at the top to 3/16 inch at the feet, the bridge will automatically flex enough to give maximum amplification. This would be the case, regardless of whether the bridge is high or low.

More particularly, the present invention incorporates a new design in a violin or viola bridge and a new material from which the violin or viola bridge is made. It has been discovered according to the present invention that if certain critical distances are achieved between the various open spaces within the bridge, the ability of the bridge to transmit vibrations from the strings to the sounding box is significantly enhanced. Present day commercial bridges which base their design on the bridge of Antonia Stradivari utilize a central open inverted heart shape with a T within its center. The lower portion of the inverted heart was placed far down on the bridge. In addition, the bridge design incorporates large holes on either side which are elevated well above the inverted heart. A variation used by commercial style bridge makers contains a central oval with an inverted T placed high on the bridge and large oval holes on either side of the bridge and beneath the central oval hole.

The bridge design of the present invention utilizes a central heart shaped opening which is right side up (as opposed to the inverted design in Stradivarious type bridges). The heart further contains an inverted T within its center. The heart is higher up on the bridge than the inverted heart in the Stradivarious design. The bridge design further contains two oval shaped side holes on either side of the heart, the midlines of which are approximately in a horizontal line with the crossbar of the inverted T within the heart. Beneath each oval shaped hole is a side hole. Each side hole is connected to the oval shaped hole above it by a slit. Finally, the lower portion of the bridge contains feet upon which the bridge rests, with an elongated opening between the feet.

It has been discovered, according to the present invention, that if certain critical distances are achieved between the interior edge of the oval hole and the edge of the central heart adjacent the oval hole along the line of the crossbar of the inverted T within the heart, and further if certain critical distances are achieved between the lower tip on the heart and the central area of the opening between the feet and also between the slits connecting the lowest side hole to the oval shaped hole and the upper tip of each outer edge of the opening between the feet, then a violin bridge with vastly improved amplification characteristics is achieved.

It has been further discovered, according to the present invention, that if the above described design is incorporated into a violin or viola bridge, the amount of space required above the area of the central heart is significantly less than that required for other bridge designs. As a result, a greater portion of the area on the upper portion of the bridge can be removed without impeding the efficiency of the bridge. This allows the one bridge design to accommodate a wide variety of violins and violas which require bridges of different heights.

It has additionally been discovered, according to the present invention, that if the violin or viola bridge is manufactured out of plastic polycarbonate which contains approximately 30 percent fiberglass, a bridge incorporating the above described design can be effectively mass produced and has significantly improved sound amplification characteristics over conventional wooden bridges. Further, the plastic polycarbonate which contains approximately 30 percent fiberglass has minimal creep characteristics. Therefore, by manufacturing the bridge out of this material, the bridge can be effectively utilized for mass production, maximum sound amplification, and extensive life.

It is therefore an object of the present invention to provide an improved violin or viola design which is capable of vastly increasing the amplification of the musical vibrations from the strings to the sounding box.

It is a further object of the present invention to provide an improved violin or viola bridge which is capable of mass production while at the same time not losing any of the important characteristics which must be maintained in order to transmit vibrations from the strings to the belly and back of the violin.

It is another object of the present invention to provide an improved violin or viola bridge design which contains the flexibility required for maximum transmission of vibrations from string to sounding box while at the same time providing a bridge of significant strength.

It is still another object of the present invention to provide an improved violin or viola bridge design which allows one manufactured mass produced bridge to be modified so as to accommodate a wide variety of violins and violas which require bridges of different heights.

It is a further object of the present invention to provide a new material from which to manufacture the above designed violin or viola bridge so as to provide a bridge which is easily mass produced, long lasting, and which will accommodate modifications which will fit any particular violin or viola.

Further novel features and other objects of the present invention will become apparent from the following detailed description and the appended claims taken in conjunction with the drawings.

DRAWING SUMMARY

Referring particularly to the drawings for the purposes of illustration only and not limitation there is illustrated:

DETAILED DESCRIPTION OF THE PREFERRED EMBODIMENT

The present invention relates to an improved violin or viola bridge design which is capable of vastly increasing the amplifications of the musical vibrations from the strings to the sounding box. The present invention also relates to an improved violin or viola bridge design which can be mass produced but allows the bridge to be modified to accommodate a multitude of violin or viola designs. The present invention also relates to the use of plastic polycarbonate material which contains approximately 30 percent fiberglass to produce a bridge which can be effectively utilized for mass production, maximum sound amplification, and extensive life.

Figure 1:
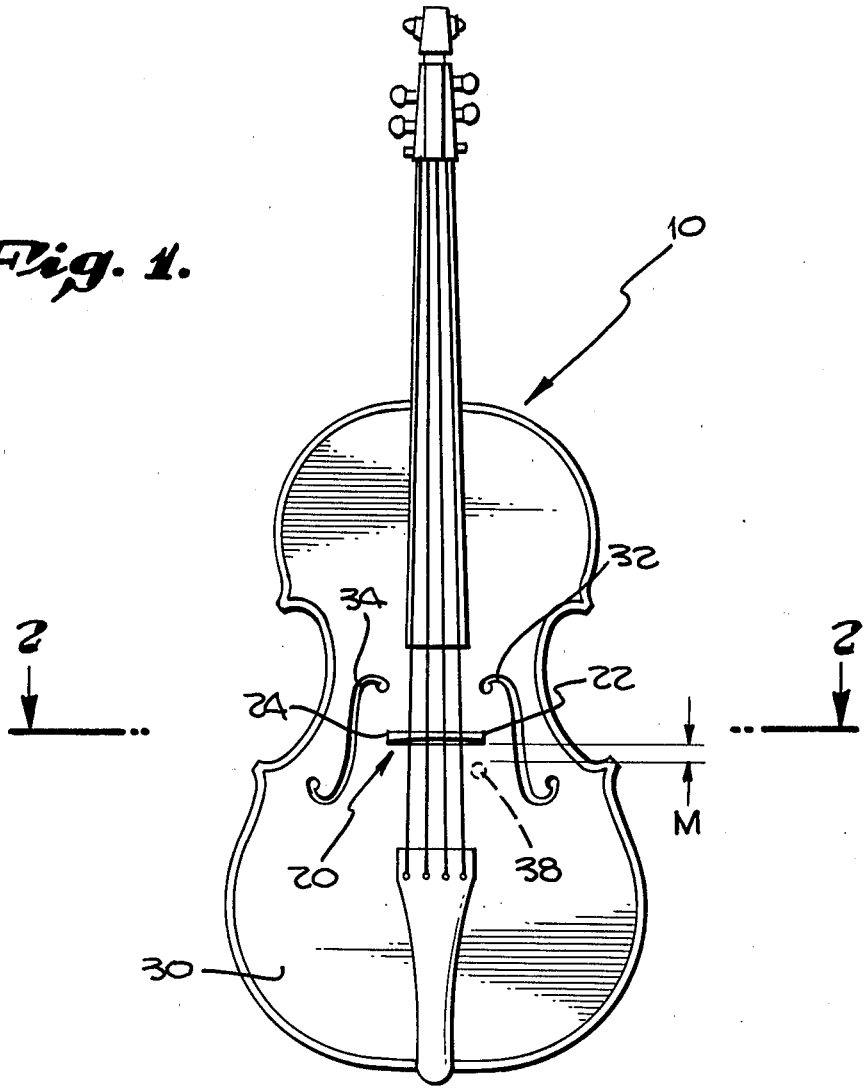
FIG. 1 is a top plan view of a violin.
Figure 2:
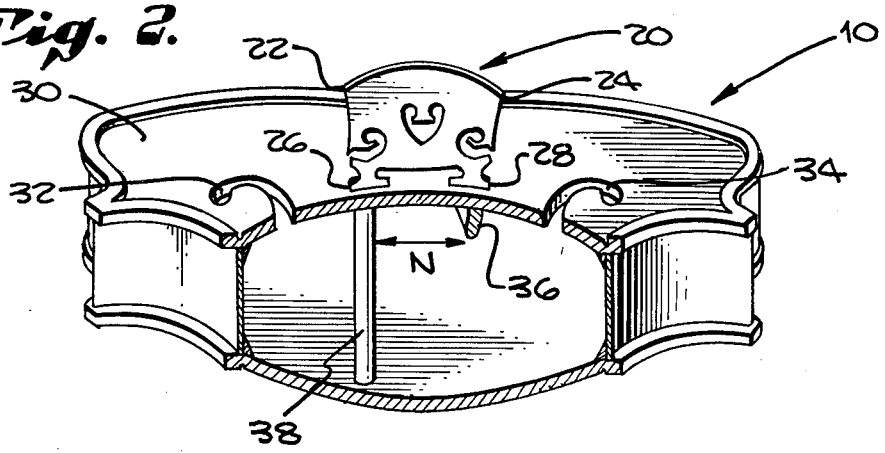
FIG. 2 is a cross-sectional rear view along line 2—2 of FIG. 1.

With reference to the drawings of the invention in detail and more particularly to FIG. 1, there is shown at 10 a standard 4—4 violin. The following discussion pertaining to violins is also applicable to violas. The violin bridge is shown at 20. FIG. 2 is a cross-sectional view taken along line 2—2 of FIG. 1. The violin bridge 20 sits on top of the belly 30 of the violin 10. The bridge 20 is placed equidistant between the first "f-hole" 32 and the second "f-hole" 34. The bass bar 36 runs directly beneath the "G" string foot 28 of the bridge on the inside of the belly 30 and the sound post 38 is in line with the "E" string foot 26 of the bridge 20 and is 5 to 6 millimeters further down on the violin 10.

Figure 3:
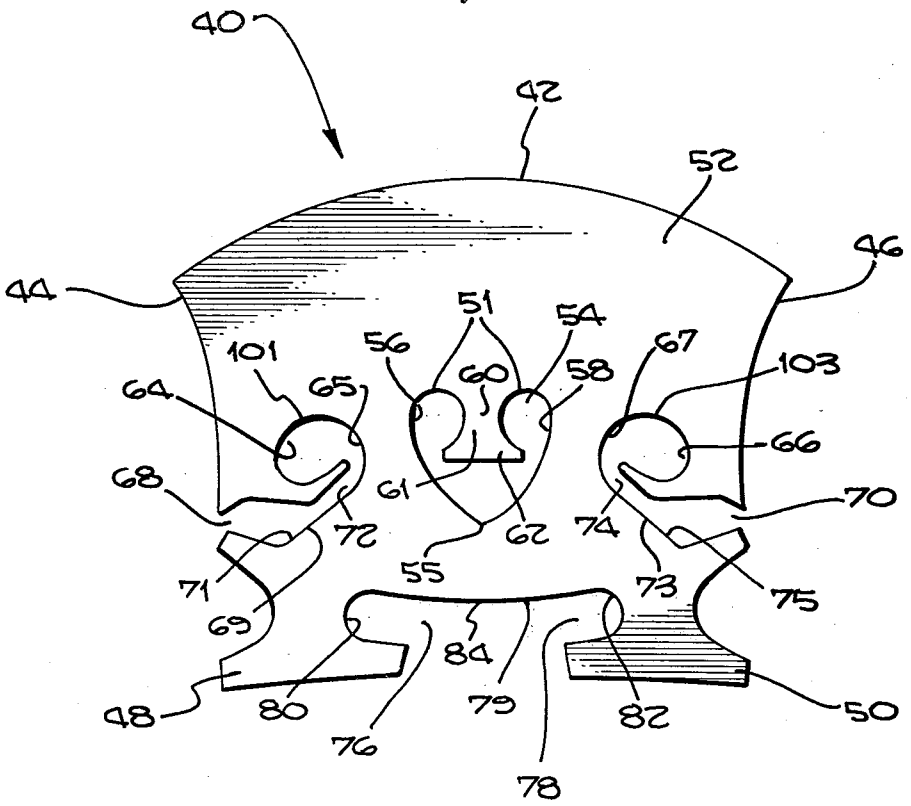
FIG. 3 is a front view of the improved violin or viola bridge.

FIG. 3 shows a front view of the improved violin bridge of the present invention. The improved violin bridge 40 contains a convexly curved top end 42, a first side 44 and a second side 46. At its lower portion, the violin bridge contains a first foot 48 and a second foot 50. These general elements are contained in violin bridges known in the prior art, such as the bridge created by Antonio Stradivari shown in FIG. 7 and a standard commerical bridge shown in FIG. 6.

One point of novelty in the present invention is the design of the open spaces within the improved violin bridge. The front face of the violin bridge is shown at 52. The front face contains a generally heart shaped opening 54 located at the central widthwise portion of the violin bridge. The heart shaped opening 54 contains an upper end 51, a lower end tip 55, a first side 56 and a second side 58. Within the heart shaped opening 54 is an inverted T 60 which contains a stem 61 and a crossbar 62. The front face 52 also contains a first generally oval shaped opening 64 which has a top edge 101, an inner edge 65 located to one side of the heart shaped opening 54 and spaced apart from it, and a second generally oval shaped opening 66 which has a top edge 103, and an inner edge 67 located on the opposite side of the heart shaped opening 54 and spaced apart from it. The front face 52 also contains a first lower edge opening 68 and a second lower edge opening 70. First lower edge opening 68 is connected to first oval shaped opening 64 by first channel 72. First channel 72 has a lower edge 71 with a central point 69. Point 69 is the approximate mid-distance along the straight portion of the edge 71 and does not include the portion which extends upwardly and outwardly to the side of the bridge. Second lower edge opening 70 is connected to second oval shaped opening 66 by second channel 74. Second channel 74 has a lower edge 75 with a central point 73. Point 73 is the approximate mid-distance along the straight portion of the edge 75 and does not include the portion which extends upwardly and outwardly to the side of the bridge.

Between first foot 48 and second foot 50 is a space 76. Above the space 76 is an elongated widthwise opening or channel 78 containing an upper surface 79 called the bow of the bridge. The bow 79 has a first upper end 80 and a second upper end 82. The central point of the bow 79 is designated at 84.

Figure 4:
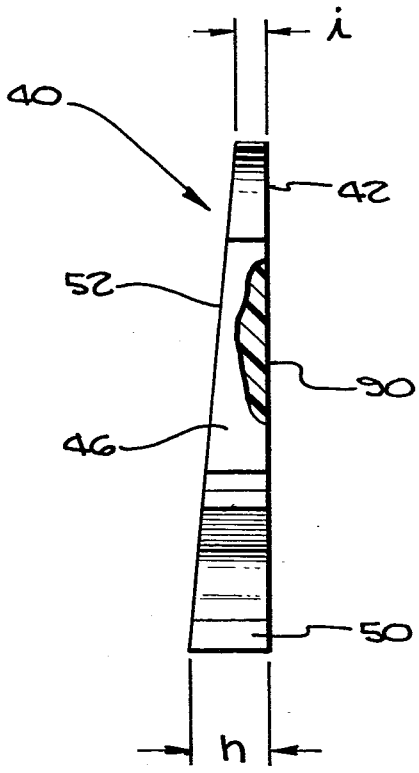
FIG. 4 is a side view of the improved violin or viola bridge.

All of the openings described above extend through the entire thickness of the improved violin (and viola) bridge, running from front face 52 to rear face 90. The side view of FIG. 4 shows that the front face 52 is sloped while the rear face 90 is straight and perpendicular to the feet of the bridge. The back face 90 of the bridge faces the bottom of the violin and the front face 52 faces the fingerboard of the violin.

In the violin, there are two resonating bodies in the area of bridge. The first is the top plate of the violin 30 in the distance between the foot of the E string side of the bridge and the sound post. In FIG. 1, the E string side of the bridge 20 is shown at 22.

The sound post 38 is directly under the dotted circle in FIG. 1. The distance between the foot of the E string side of the bridge 22 at the sound post 38 is designated as M. In a standard 4—4 violin, this is five to six millimeters. The sound post 38 acts as the fulcrum and the vibration is set up along the distance M. The second resonating body is the distance between the foot 26 of the E string side of the bridge 22 and the foot 28 at the G string side of the bridge 24. The foot 26 on the E string side of the bridge is much stiffer and moves significantly less than the foot 28 on the G string side of the bridge 24. The distance between foot 26 and foot 28 is designated as N in FIG. 2. Here, the foot 26 acts as a fulcrum and vibration from the strings is transmitted to feet 26 and 28 and a resonance is set up between feet 26 and 28. Foot 28 is much more flexible since it does not have the sound post 38 on its side, and therefore it transmits most of the vibration to bass bar 36 located directly beneath it. The bass bar transmits the vibration through the sounding box of the violin, in all directions. Therefore, the areas of primary resonance at the site of the bridge are along distances M and N. It can readily be seen that in order for proper vibrations from the strings to be transmitted to the feet of the bridge and from them to the sounding box, the bridge must have a proper amount of flexibility; not too much and not too little. The present invention creates a violin bridge which is perfectly designed with the proper amount of flexibility built into its design. The design is based on having certain critical distances between the central heart shaped opening in the violin bridge and other areas of the violin bridge.

Figure 5:
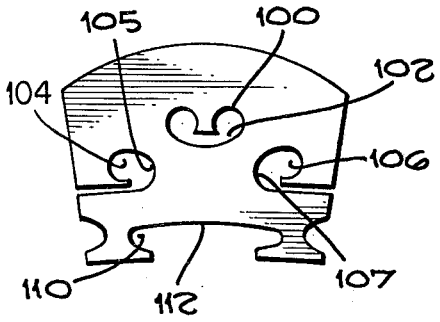
PRIOR ART Fig. 5.
FIG. 5 is a front view of a commonly used commercial violin bridge.
Figure 6:
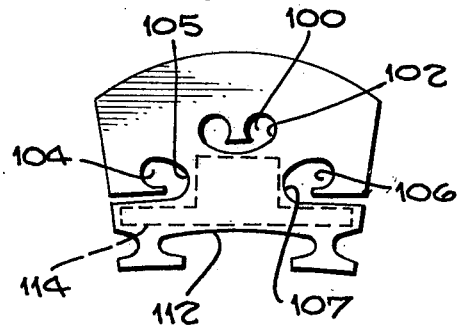
PRIOR ART Fig. 6.
FIG. 6 is a view of the commonly used commercial violin bridge with emphasis on the form of the lower portion.

An examination of several prior art violin bridges will show the flaw that all of them contain. One of the most common commercial violin bridges presently in use is shown in FIG. 5. The bridge contains an open oval 100 high on the bridge. The oval has a lower edge 102. Oval side opening 104 with an inner edge 105 and oval side opening 106 with inner edge 107 are also present. The lower portion of the bridge has a channel 110 between the feet. The channel's upper surface 112 is called the bow. The bow 112 in the commercial bridge is slightly concave upwards. The flaw in this bridge design is illustrated in FIG. 6. The dotted line 114 shows an imaginary upside down T being formed in the area bordered by the surfaces 102, 105, 107 at the oval holes and the bow 112. The strings create circular and vertical vibrations which are transmitted from the top of the bridge to its feet to sounding box. Because the standard commercial bridge has an inverted T shaped design on its lower portion, a circularly emanating vertical vibration force from the strings creates very little vertical vibration in the lower portion of the bridge. The inverted lower T design of the standard commercial bridge mutes the vibrations from the strings and thereby causes a decrease in amplification to the feet which in turn transmits less vibration to the sound box. Therefore, the bridge design is much too stiff, does not vibrate properly, and dampens and mutes the sound. In order to get proper vibration in this design, the bridge has to be shaved on its planar faces until it is exceedingly thin; so thin that it is in danger of collapse or very rapid warping.

Figure 7:
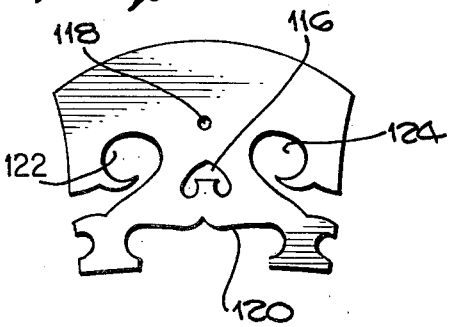
PRIOR ART Fig. 7.
FIG. 7 is a front view of the violin bridge of Antonio Stradivari.

FIG. 7 discloses the violin bridge design by the famous violin maker Antonio Stradivari. The bridge has an upside down heart 116, a hole 118 high on the bridge and a concave bow 120 with a point in the middle. There are also side oval holes 122 and 124 which are higher than the inverted heart 116. This bridge design also has serious flaws. The inverted heart 116 which is below the oval side holes 122 and 124 serves to stiffen the bridge and creates the same problems as discussed above for the standard commercial bridge. The inverted heart mutes and dampens the vibrations from the strings. The concave bridge bow 120 also serves to stiffen the bridge and causes further muting and dampening of the vibrations. Stradivari tried to solve the problem by placing a hole 118 in the bridge but this was still very ineffective.

Figure 8:
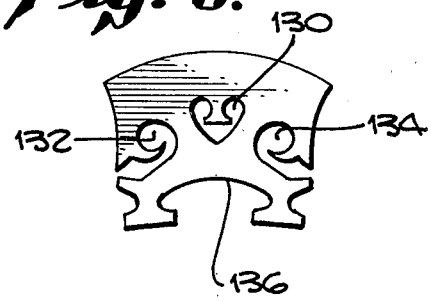
PRIOR ART Fig. 8.
FIG. 8 is a front view of the violin bridge of Ralph Tiebout and Frederick Gosparlin.

The closest prior art developed was the bridge disclosed in FIG. 8. The bridge was developed in the early 1970's by the present inventor Ralph Tiebout, III and the late Frederick Gosparlin. Although at first glance the bridge appears similar to the present invention, there are several critical differences. The bridge has a central heart shaped opening 130 which is located high on the bridge and well above side oval holes 132 and 134. The bow at the bridge 136 is very heavily concave upwards. This violin bridge was a commercial failure because it also served to very heavily dampen and mute the vibrations from the strings. The location of the heart 130 on the bridge was far too high and the heavily concave bow further serves to dampen and mute the vibrations.

Figure 9:
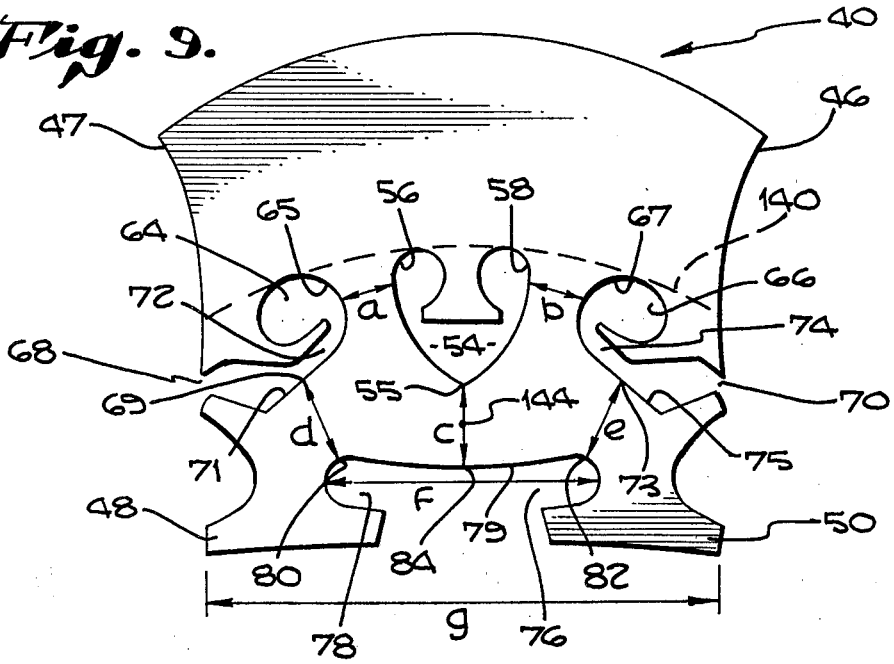
FIG. 9 is a front view of the improved violin or viola bridge with emphasis on critical dimension lines.

The present invention has solved these stiffness problems in the bridge and has created a violin bridge which vibrates within itself, thereby adding a third vibrating element to the first two already mentioned which are inherent in the violin design. The present invention is disclosed in FIG. 3 and in FIG. 9. FIG. 3 was a detailed description of its elements. In FIG. 9, the critical elements are discussed. The vastly increased bridge flexibility is accomplished by inverting the bow 79 so that it is convex instead of concave. The highest points on the inverted bow 79 are its ends 80 and 82. Its central portion is 84. The convex bow 79 significantly increases the flexibility of the bridge. Further, the creation of a convex box 79 allows the open heart 54 to be lowered significantly so that its upper end 51 forms a curve with the upper edges 101 and 102 of generally oval shaped side holes 64 and 66 which is substantially parallel to the curve of upper end 42 of the bridge. This is shown by the dotted line 140 in FIG. 9. This lowering of the heart along with its proper dimensional characteristics and formation of the three hole upper end and edges curve parallel to the upper end of the bridge creates a lower bridge design which sets up the vibrations within the bridge itself. The upper edge of first oval shaped opening 64, the heart shaped opening 54 and second oval shaped opening 66 form a curve 140 which is parallel to the curve of the upper edge 42 of violin bridge 40. The design causes a fundamental mode of vibration across the upper area of the generally oval shaped holes and upper end of the heart, along dotted curved line 140. The distance between the lower point of the heart 55 and the central point 84 of the bow is such that a central pivot point 144 is set up equidistant from the points 55 and 84. This design serves to complement and enhance the vertical and circular vibrations from the strings. Further, this circular vibration inside the bridge with its pivot point at 144 and its fundamental mode of vibration along line 140 blends with the circular motion from the strings and these combine with the rocking motion within the bridge along distance N from the E string foot 48 to the G string foot 50. As a result, through this design, there is a natural amplification which serves to significantly enhance the vibration set up on the strings and transmit them to the sounding box. As a result, through this vastly improved violin bridge design, the flexibility is inherent in the design and it is not necessary to make the bridge as thin as other bridges. Therefore, the bridge is in no danger of collapse or warping and has a vastly improved life.

This design is applicable to all sizes of violins and violas. The critical dimensions for the bridge design are located along the following distances. The nearest distance between the first side 56 of the heart 54 and the inner edge 65 of the first oval shaped opening 64. This is distance "a" in FIG. 9. The nearest distance between the second side 58 of the heart 54 and the inner edge 67 of the second oval shaped opening 66. This is distance "b." Distances "a" and "b" are equal. The vertical distance between the lower tip 55 of the heart 54 and the approximate central point 84 of the bow 79. This is distance "c" in FIG. 9.

The nearest distance between the approximate central point 69 of the lower edge 71 of first channel or downwardly and outwardly extending section 72 and the first upper end 80 of convexly downwardly curved upper edge or bow 79. This is distance "d" in FIG. 9. Downwardly and outwardly extending section 72 extends into an upwardly and outwardly extending section or lower edge opening 68 which terminates at first edge 44 of the violin bridge 40. Sections 68 and 72 comprise a first lower edge opening, but it is only distance "d" from section 72 which is critical. The nearest distance between the approximate central point 73 of the lower edge 75 of channel or downwardly and outwardly extending section 74 and the second upper end 82 of convexly downwardly curved upper edge or bow 79. This is distance "e" in FIG. 9. Downwardly and outwardly extending section 74 extends into upwardly and outwardly extending section or lower edge opening 70 which terminates at second edge 46 of the violin bridge 40. Sections 70 and 74 comprise a second lower edge opening but it is only distance "e" from section 74 which is critical. Distances "d" and "e" are equal. Finally, the widthwise distance of the elongated widthwise opening or channel 78 beneath the convexly downwardly curved upper edge or bow 79. This is distance "f" in FIG. 9. This specific distance is not as critical as distances "a" through "e."

Distance "g" is the distance between the ends of the feet 48 and 50. This distance "g" is standard for all bridges that go with a specific violin or viola size. Referring to FIG. 4, the thickness at the bottom of the bridge is distance "h" and the thickness at the top of this bridge is distance "i." The critical distances listed herein are approximate distances. Slight variances from these distances will still work and are within the spirit and scope of the present invention.

The following chart lists the approximate critical distances for various violin and viola sizes. Distance "g" is standard for any violin bridge or viola bridge of that size. All distances are in millimeters.

VIOLIN BRIDGE APPROXIMATE CRITICAL DISTANCES

| | Violin Size | | | | | |
|---|---|---|---|---|---|---|
| Distance mm | Standard 4-4 | ¾ Size | ½ Size | ¼ Size | ⅛ Size | 1/16 Size |
| a | 4 | 4 | 4 | 4 | 3 | 3 |
| b | 4 | 4 | 4 | 4 | 3 | 3 |
| c | 7 | 6 | 5 | 5 | 4 | 4 |
| d | 5.5 | 5 | 4 | 4 | 3 | 3 |
| e | 5.5 | 5 | 4 | 4 | 3 | 3 |
| f | 24 | 23 | 23 | 22 | 20 | 18 |
| g | 42 | 39 | 37 | 33 | 30 | 27 |
| h | 5.5 | 5 | 4.5 | 4 | 3.5 | 3.5 |
| i | 1.75 | 1.7 | 1.5 | 1.4 | 1.3 | 1.2 |

VIOLA BRIDGE APPROXIMATE CRITICAL DISTANCES

| Distance mm | Viola Size Standard 4-4 Size |
|---|---|
| a | 6 |
| b | 6 |
| c | 9 |
| d | 6 |
| e | 6 |
| f | 28 |
| g | 48 |
| h | 6.5 |
| i | 2.0 |

These critical distances are very important. If the heart shaped opening 54 were lower, the bridge would sound flat. If the oval side holes 64 and 66 were higher, the bridge would be too stiff and the amplification would be improper. If the oval shaped side holes 64 and 66 were further down, the bridge would once again be too flexible.

The use of the inverted T 60 within the heart shaped opening 54 is not necessary and it can be eliminated without impairing the effectiveness of the bridge. The T 60 is used for easy fabrication and the crossbar portion 62 is useful in aligning the centerlines of the oval shaped holes 64 and 66.

As mentioned earlier, the height of the violin bridge will have to vary based on the required playing height of the strings. Therefore, to accommodate each bridge to a specific violin, it is necessary to shave off a portion of the upper portion of the bridge in order to accommodate a specific violin. The bridge design of the present invention offers a significant improvement over all bridge designs of the prior art in this area as well. The bridge designs of the prior art all have openings high up on the bridge. There must be a minimum distance of solid bridge above the highest opening in order for the violin to work properly. With openings high on the bridge, the amount of material which can be taken off the top and still leave a functioning bridge is significantly reduced. Therefore, prior art bridges can accommodate only a limited number of violin and viola variations for differing required heights of the strings. The bridge of the present invention has its open heart well down on the bridge. Therefore, there is a significant amount of material above the heart shaped openings. The bridge will work at optimum level as long as there is unopened bridge material at least 4.763 mm (or 3/16 inch) above the heart. On a standard 4-4 violin, the total bridge height is approximately forty-two millimeters. Therefore, the bridge may be modified by removing desired amounts of material from its upper end to provide a desired elevation at which the violin or viola strings are supported above the belly without detracting from the sound amplification or transmission ability of the bridge. The only other requirement is that the thickness of the bridge at its upper end must be brought down to the original upper end thickness of 1.75 mm for a standard 4-4 violin and comparable thicknesses as per the above chart for other bridges in other violin sizes as shown in FIG. 4. There is a gradual taper on the front face so the upper part of the front face will have to be sanded to bring the thickness within the required distance. Therefore, there is a lot of material above the heart 54 and the bridge can have significant amounts of material removed from it without impairing its performance. Therefore, the bridge of the present invention can accommodate a vast number of string heights for violins and violas. Therefore, one standard bridge for a given violin size can accommodate almost any required string height desired for that violin. Therefore, uniformity in mass production is achieved. This is a significant improvement over prior art violin and viola bridges.

All prior art violin and viola bridges have been made of hard wood such as spotted maple. This requires hours of painstaking labor and virtually precludes the possibility of mass production. It has been discovered, according to the present invention, that plastic material made of polycarbonate that contains approximately thirty percent fiberglass provides an excellent material for violin and viola bridges. Such a material creates a bridge that creeps less than bridges made of wood, is more flexible than bridges made of wood and is much stronger than bridges made of wood. In addition, the use of this plastic material enables the present bridge design to be created by injection molding which therefore allows for mass production of the bridge. Therefore the use of polycarbonate which contains approximately thirty percent fiberglass for the violin bridge and viola bridge material is a significant improvement over the use of wood.

In addition to facilitating ease of mass production through injection molding or other comparable means for this complex bridge design, the use of plastic material made of polycarbonate that contains approximately thirty percent fiberglass produces a violin or viola bridge with vastly improved sound amplification characteristics. A violin or viola bridge made of polycarbonate with approximately thirty percent fiberglass amplifies the sound from each of the four strings to a level far greater than the amplification achieved by conventional bridges made of wood such as spotted maple. The design of the present invention can be used with violin and viola bridges made of wood such as spotted maple and significantly improves the amplification characteristics of such bridges. If the design of the present invention is used with a violin or viola bridge made of polycarbonate that contains approximately thirty percent fiberglass, the amplification characteristics of the bridge are enhanced to an even greater extent. In addition, the bridge is much stronger than conventional wooden bridges, and can withstand far more pressure from the strings without breaking or warping. Although the use of plastic material such as polycarbonate containing approximately thirty percent fiberglass has been stressed, other plastic based polymers and materials can also be used for the improved violin and viola bridge and are within the spirit and scope of the present invention.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

I claim:

1. An improved bridge for a violin of the type comprising an integrally formed member adapted to rest upon the belly of the violin and extend transversely beneath the strings with a convexly curved upper surface for supporting the strings, characterized in that it has a central opening and a pair of lateral edge openings for increasing its flexibility and hence sound transmitting and amplifying capability with the upper boundary of the three openings lying along a curved path that is substantially parallel to the curved upper end of said bridge and further characterized in that its bottom end has feet on its lateral edges with a bottom channel therebetween, the upper extremity of the channel being formed by a slightly downwardly convex surface of the bridge.

2. An improved violin bridge of the type characterized by a generally wedge shaped member having a pair of protruding feet on the corners of its thicker bottom end and having its thinner top end convexly curved across its width, and further having a first side and a second side, wherein the improved violin bridge for a standard 4-4 size violin comprizes:

a. a generally heart shaped opening with its pointed end extending downwardly, comprising a first side, a second side, an upper end, and a lower pointed end, located at the central widthwise portion of said violin bridge;

b. a first generally oval shaped opening which has an inner edge spaced apart from said first side of said generally heart shaped opening, and an upper edge, being located to one side of said generally heart shaped opening;

c. a first lower edge opening extending from said inner edge of said first generally oval shaped opening, comprising a downwardly and outwardly extending section which extends into an upwardly and outwardly extending section which terminates at the first edge of said violin bridge;

d. a second generally oval shaped opening which has an inner edge spaced apart from said second side of said generally heart shaped opening, and an upper edge, being located on the side of said violin bridge opposite said first generally oval shaped opening;

e. a second lower edge opening extending from said inner edge of said second generally oval shaped opening, comprising a downwardly and outwardly extending section which extends into an upwardly and outwardly extending section which terminates at the second edge of said violin bridge;

f. the upper edge of said first generally oval shaped opening, the upper end of said generally heart shaped opening, and the upper edge of said second generally oval shaped opening forming a curve which is substantially parallel to the curve of the upper end of said violin bridge;

g. the distance between the curve formed by the upper edge of said first generally oval shaped opening, the upper end of said generally heart shaped opening, and the upper edge of said second generally oval shaped opening, and the curve of the upper end of said violin bridge being sufficient to allow a substantial unopened amount of bridge material therebetween;

h. an elongated widthwise opening containing a convexly downwardly curved upper edge located between said two feet of said violin bridge;

i. said elongated widthwise opening further comprising a first upper end and a second upper end located at the opposite sides of its convexly curved upper edge;

j. the nearest distance between said inner edge of said first generally oval shaped opening and said first side of said generally heart spaced opening being approximately four millimeters;

k. the nearest distance between said inner edge of the second generally oval shaped opening and said second side of said generally heart shaped opening being approximately four millimeters;

l. the nearest distance between the approximate lower edge central point of the downwardly and outwardly extending section of said first lower edge opening and first upper end of said elongated widthwise opening being approximately five and one-half millimeters;

m. the nearest distance between the approximate lower edge central point of the downwardly and outwardly extending section of said second lower edge opening and the second upper end of said elongated widthwise opening being approximately five and one-half millimeters; and n. the vertical distance between the lower pointed end of said generally heart shaped opening and the approximate central point of said convexly curved upper edge of said elongated widthwise opening being approximately seven millimeters;

o. whereby the openings and critical distances between the opening enables said violin bridge to have substantially increased flexibility in order to significantly amplify the vibrations set up on the bowed strings of the violin and significantly improve the transmission of the vibrations from the bowed strings to the sounding box of the violin on which said violin bridge rests, and wherein the substantial amount of unopened bridge material above the curve formed by the upper edge of said first generally oval shaped opening, the upper end of said generally heart shaped opening, and the upper edge of said second generally oval shaped opening allows the bridge to be modified by removing desired amounts of material from its upper end to provide a desired elevation at which the violin strings are supported above the belly of the violin without detracting from the sound amplification and transmission ability of the violin bridge.

3. An improved violin bridge as defined in claim 2 wherein said elongated widthwise opening located between said two feet is approximately twenty-four millimeters.

4. An improved violin bridge as defined in claim 2 wherein the thickness of the bottom of said violin bridge is approximately five and one-half millimeters and the thickness of the top end of said violin bridge is approximately one and three-quarters millimeters.

5. An improved violin bridge as defined in claim 2 wherein said violin bridge is made of spotted maple wood.

6. An improved violin bridge as defined in claim 2 wherein said violin bridge is made of polycarbonate which contains approximately thirty percent (30%) fiberglass.

7. An improved violin bridge as defined in claim 2 wherein said violin bridge is made of plastic material and formed through injection molding.

8. An improved violin bridge of the type characterized by a generally wedge shaped member having a pair of protruding feet on the corners of its thicker bottom end and having its thinner top end convexly curved across its width, and further having a first side and a second side, wherein the improved violin bridge for a three quarter size violin comprises:

a. a generally heart shaped opening with its pointed end extending downwardly, comprising a first side, a second side, an upper end, and a lower pointed end, located at the central widthwise portion of said violin bridge;

b. a first generally oval shaped opening which has an inner edge spaced apart from said first side of said generally heart shaped opening, and an upper edge, being located to one side of said generally heart shaped opening;

c. a first lower edge opening extending from said inner edge of said first generally oval shaped opening, comprising a downwardly and outwardly extending section which extends into an upwardly and outwardly extending section which terminates at the first edge of said violin bridge;

d. a second generally oval shaped opening which has an inner edge spaced apart from said second side of said generally heart shaped opening, and an upper edge, being located on the side of said violin bridge opposite said first generally oval shaped opening;

e. a second lower edge opening extending from said inner edge of said second generally oval shaped opening, comprising a downwardly and outwardly extending section which extends into an upwardly and outwardly extending section which terminates at the second edge of said violin bridge;

f. the upper edge of said first generally oval shaped opening, the upper end of said generally heart shaped opening, and the upper of said second generally oval shaped opening forming a curve which is substantially parallel to the curve of the upper end of said violin bridge;

g. the distance between the curve formed by the upper edge of said first generally oval shaped opening, the upper end of said generally heart shaped opening, and the upper edge of said second generally oval shaped opening, and the curve of the upper end of said violin bridge being sufficient to allow a substantial unopened amount of bridge material therebetween;

h. an elongated widthwise opening containing a convexly downwardly curved upper edge located between said two feet of said violin bridge;

i. said elongated widthwise opening further comprising a first upper end and a second upper end located at the opposite sides of its convexly curved upper edge;

j. the nearest distance between said inner edge of said first generally oval shaped opening and said first side of said generally heart shaped opening being approximately four millimeters;

k. the nearest distance between said inner edge of the second generally oval shaped opening and said second side of said generally heart shaped opening being approximately four millimeters;

l. the nearest distance between the approximate lower edge central point of the downwardly and outwardly extending section of said first lower edge opening and first upper end of said elongated widthwise opening being approximately five millimeters;

m. the nearest distance between the approximate lower edge central point of the downwardly and outwardly extending section of said second lower edge opening and the second upper end of said elongated widthwise opening being approximately five millimeters; and n. the vertical distance between the lower pointed end of said generally heart shaped opening and the approximate central point of said convexly curved upper edge of said elongated widthwise opening being approximately six millimeters;

o. whereby the openings and cricital distances between the opening enables said violin bridge to have substantially increased flexibility in order to significantly amplify the vibrations set up on the bowed strings of the violin and significantly improve the transmission of the vibrations from the bowed strings to the sounding box of the violin on which said violin bridge rests, and wherein the substantial amount of unopened bridge material above the curve formed by the upper edge of said first generally oval shaped opening, the upper end of said generally heart shaped opening, and the upper edge of said second generally oval shaped opening allows the bridge to be modified by removing desired amounts of material from its upper end to provide a desired elevation at which the violin strings are supported above the belly of the violin without detracting from the sound amplification and transmission ability of the violin bridge.

9. An improved violin bridge as defined in claim 8 wherein said elongated widthwise opening located between said two feet is approximately twenty-three millimeters.

10. An improved violin bridge as defined in claim 8 wherein the thickness of the bottom of said violin bridge is approximately five millimeters and the thickness of the top end of said violin bridge is approximately one and seven-tenths millimeters.

11. An improved violin bridge as defined in claim 8 wherein said violin bridge is made of spotted maple wood.

12. An improved violin bridge as defined in claim 8 wherein said violin bridge is made of polycarbonate which contains approximately thirty percent (30%) fiberglass.

13. An improved violin bridge as defined in claim 8 wherein said violin bridge is made of plastic material and formed through injection molding.

14. An improved violin bridge of the type characterized by a generally wedge shaped member having a pair of protruding feet on the corners of its thicker bottom end and having its thinner top end convexly curved across its width, and further having a first side and a second side, wherein the improved violin bridge for a one-half size violin comprises:

a. a generally heart shaped opening with its pointed end extending downwardly, comprising a first side, a second side, an upper end, and a lower pointed end, located at the central widthwise portion of said violin bridge;

b. a first generally oval shaped opening which has an inner edge spaced apart from said first side of said generally heart shaped opening, and an upper edge, being located to one side of said generally heart shaped opening;

c. a first lower edge opening extending from said inner edge of said first generally oval shaped opening, comprising a downwardly and outwardly extending section which extends into an upwardly and outwardly extending section which terminates at the first edge of said violin bridge;

d. a second generally oval shaped opening which has an inner edge spaced apart from said second side of said generally heart shaped opening, and an upper edge, being located on the side of said violin bridge opposite said first generally oval shaped opening;

e. a second lower edge opening extending from said inner edge of said second generally oval shaped opening, comprising a downwardly and outwardly extending section which extends into an upwardly and outwardly extending section which terminates at the second edge of said violin bridge;

f. the upper edge of said first generally oval shaped opening, the upper end of said generally heart shaped opening, and the upper edge of said second generally oval shaped opening forming a curve which is substantially parallel to the curve of the upper end of said violin bridge;

g. the distance between the curve formed by the upper edge of said first generally oval shaped opening, the upper end of said generally heart shaped opening, and the upper edge of said second generally oval shaped opening, and the curve of the upper end of said violin bridge being sufficient to allow a substantial unopened amount of bridge material therebetween;

h. an elongated widthwise opening containing a convexly downwardly curved upper edge located between said two feet of said violin bridge;

i. said elongated widthwise opening further comprising a first upper end and a second upper end located at the opposite sides of its convexly curved upper edge;

j. the nearest distance between said inner edge of said first generally oval shaped opening and said first side of said generally heart shaped opening being approximately four millimeters;

k. the nearest distance between said inner edge of the second generally oval shaped opening and said second side of said generally heart shaped opening being approximately four millimeters;

l. the nearest distance between the approximate lower edge central point of the downwardly and outwardly extending section of said first lower edge opening and first upper end of said elongated widthwise opening being approximately four millimeters;

m. the nearest distance between the approximate lower edge central point of the downwardly and outwardly extending section of said second lower edge opening and the second upper end of said elongated widthwise opening being approximately four millimeters; and n. the vertical distance between the lower pointed end of said generally heart shaped opening and the approximate central point of said convexly curved upper edge of said elongated widthwise opening being approximately five millimeters;

o. whereby the openings and cricital distances between the opening enables said violin bridge to have substantially increased flexibility in order to significantly amplify the vibrations set up on the bowed strings of the violin and significantly improve the transmission of the vibrations from the bowed strings to the sounding box of the violin on which said violin bridge rests, and wherein the substantial amount of unopened bridge material above the curve formed by the upper edge of said first generally oval shaped opening, the upper end of said generally heart shaped opening, and the upper edge of said second generally oval shaped opening allows the bridge to be modified by removing desired amounts of material from its upper end to provide a desired elevation at which the violin strings are supported above the belly of the violin without detracting from the sound amplification and transmission ability of the violin bridge.

15. An improved violin bridge as defined in claim 14 wherein said elongated widthwise opening located between said two feet is approximately twenty-three millimeters.

16. An improved violin bridge as defined in claim 14 wherein the thickness of the bottom of said violin bridge is approximately four and one-half millimeters and the thickness of the top end of said violin bridge is approximately one and one-half millimeters.

17. An improved violin bridge as defined in claim 14 wherein said violin bridge is made of spotted maple wood.

18. An improved violin bridge as defined in claim 14 wherein said violin bridge is made of polycarbonate which contains approximately thirty percent (30%) fiberglass.

19. An improved violin bridge as defined in claim 14 wherein said violin bridge is made of plastic material and formed through injection molding.

20. An improved violin bridge of the type characterized by a generally wedge shaped member having a pair of protruding feet on the corners of its thicker bottom end and having its thinner top end convexly curved across its width, and further having a first side and a second side, wherein the improved violin bridge for a one-quarter size violin comprises:

a. a generally heart shaped opening with its pointed end extending downwardly, comprising a first side, a second side, an upper end, and a lower pointed end, located at the central widthwise portion of said violin bridge;

b. a first generally oval shaped opening which has an inner edge spaced apart from said first side of said generally heart shaped opening, and an upper edge, being located to one side of said generally heart shaped opening;

c. a first lower edge opening extending from said inner edge of said first generally oval shaped opening, comprising a downwardly and outwardly extending section which extends into an upwardly and outwardly extending section which terminates at the first edge of said violin bridge;

d. a second generally oval shaped opening which has an inner edge spaced apart from said second side of said generally heart shaped opening, and an upper edge, being located on the side of said violin bridge opposite said first generally oval shaped opening;

e. a second lower edge opening extending from said inner edge of said second generally oval shaped opening, comprising a downwardly and outwardly extending section which extends into an upwardly and outwardly extending section which terminates at the second edge of said violin bridge;

f. the upper edge of said first generally oval shaped opening, the upper end of said generally heart shaped opening, and the upper edge of said second generally oval shaped opening forming a curve which is substantially parallel to the curve of the upper end of said violin bridge;

g. the distance between the curve formed by the upper edge of said first generally oval shaped opening, the upper end of said generally heart shaped opening, and the upper edge of said second generally oval shaped opening, and the curve of the upper end of said violin bridge being sufficient to allow a substantial unopened amount of bridge material therebetween;

h. an elongated widthwise opening containing a convexly downwardly curved upper edge located between said two feet of said violin bridge;

i. said elongated widthwise opening further comprising a first upper end and a second upper end located at the opposite sides of its convexly curved upper edge;

j. the nearest distance between said inner edge of said first generally oval shaped opening and said first side of said generally heart shaped opening being approximately four millimeters;

k. the nearest distance between said inner edge of the second generally oval shaped opening and said second side of said generally heart shaped opening being approximately four millimeters;

l. the nearest distance between the approximate lower edge central point of the downwardly and outwardly extending section of said first lower edge opening and first upper end of said elongated widthwise opening being approximately four millimeters;

m. the nearest distance between the approximate lower edge central point of the downwardly and outwardly extending section of said second lower edge opening and the second upper end of said elongated widthwise opening being approximately four millimeters; and n. the vertical distance between the lower pointed end of said generally heart shaped opening and the approximate central point of said convexly curved upper edge of said elongated widthwise opening being approximately five millimeters;

o. whereby the openings and cricital distances between the opening enables said violin bridge to have substantially increased flexibility in order to significantly amplify the vibrations set up on the bowed strings of the violin and significantly improve the transmission of the vibrations from the bowed strings to the sounding box of the violin on which said violin bridge rests, and wherein the substantial amount of unopened bridge material above the curve formed by the upper edge of said first generally oval shaped opening, the upper end of said generally heart shaped opening, and the upper edge of said second generally oval shaped opening allows the bridge to be modified by removing desired amounts of material from its upper end to provide a desired elevation at which the violin strings are supported above the belly of the violin without detracting from the sound amplification and transmission ability of the violin bridge.

21. An improved violin bridge as defined in claim 20 wherein said elongated widthwise opening located between said two feet is approximately twenty-two millimeters.

22. An improved violin bridge as defined in claim 20 wherein the thickness of the bottom of said violin bridge is approximately four millimeters and the thickness of the top end of said violin bridge is approximately one and four-tenths millimeters.

23. An improved violin bridge as defined in claim 20 wherein said violin bridge is made of spotted maple wood.

24. An improved violin bridge as defined in claim 20 wherein said violin bridge is made of polycarbonate which contains approximately thirty percent (30%) fiberglass.

25. An improved violin bridge as defined in claim 20 wherein said violin bridge is made of plastic material and formed through injection molding.

26. An improved violin bridge of the type characterized by a generally wedge shaped member having a pair of protruding feet on the corners of its thicker bottom end and having its thinner top end convexly curved across its width, and further having a first side and a second side, wherein the improved violin bridge for a one-eighth size violin comprises:

a. a generally heart shaped opening with its pointed end extending downwardly, comprising a first side, a second side, an upper end, and a lower pointed end, located at the central widthwise portion of said violin bridge;

b. a first generally oval shaped opening which has an inner edge spaced apart from said first side of said generally heart shaped opening, and an upper edge, being located to one side of said generally heart shaped opening;

c. a first lower edge opening extending from said inner edge of said first generally oval shaped opening, comprising a downwardly and outwardly extending section which extends into an upwardly and outwardly extending section which terminates at the first edge of said violin bridge;

d. a second generally oval shaped opening which has an inner edge spaced apart from said second side of said generally heart shaped opening, and an upper edge, being located on the side of said violin bridge opposite said first generally oval shaped opening;

e. a second lower edge opening extending from said inner edge of said second generally oval shaped opening, comprising a downwardly and outwardly extending section which extends into an upwardly and outwardly extending section which terminates at the second edge of said violin bridge;

f. the upper edge of said first generally oval shaped opening, the upper end of said generally heart shaped opening, and the upper edge of said second generally oval shaped opening forming a curve which is substantially parallel to the curve of the upper end of said violin bridge;

g. the distance between the curve formed by the upper edge of said first generally oval shaped opening, the upper end of said generally heart shaped opening, and the upper edge of said second generally oval shaped opening, and the curve of the upper end of said violin bridge being sufficient to allow a substantial unopened amount of bridge material therebetween;

h. an elongated widthwise opening containing a convexly downwardly curved upper edge located between said two feet of said violin bridge;

i. said elongated widthwise opening further comprising a first upper end and a second upper end located at the opposite sides of its convexly curved upper edge;

j. the nearest distance between said inner edge of said first generally oval shaped opening and said first side of said generally heart shaped opening being approximately three millimeters;

k. the nearest distance between said inner edge of the second generally oval shaped opening and said second side of said generally heart shaped opening being approximately three millimeters;

l. the nearest distance between the approximate lower edge central point of the downwardly and outwardly extending section of said first lower edge opening and first upper end of said elongated widthwise opening being approximately three millimeters;

m. the nearest distance between the approximate lower edge central point of the downwardly and outwardly extending section of said second lower edge opening and the second upper end of said elongated widthwise opening being approximately three millimeters; and n. the vertical distance between the lower pointed end of said generally heart shaped opening and the approximate central point of said convexly curved upper edge of said elongated widthwise opening being approximately four millimeters;

0. whereby the openings and cricital distances between the opening enables said violin bridge to have substantially increased flexibility in order to significantly amplify the vibrations set up on the bowed strings of the violin and significantly improve the transmission of the vibrations from the bowed strings to the sounding box of the violin on which said violin bridge rests, and wherein the substantial amount of unopned bridge material above the curve formed by the upper edge of said first generally oval shaped opening, the upper end of said generally heart shaped opening, and the upper edge of said second generally oval shaped opening allows the bridge to be modified by removing desired amounts of material from its upper end to provide a desired elevation at which the violin strings are supported above the belly of the violin without detracting from the sound amplification and transmission ability of the violin bridge.

27. An improved violin bridge as defined in claim 26 wherein said elongated widthwise opening located between said two feet is approximately twenty millimeters.

28. An improved violin bridge as defined in claim 26 wherein the thickness of the bottom of said violin bridge is approximately three and one-half millimeters and the thickness of the top end of said violin bridge is approximately one and three tenths millimeters.

29. An improved violin bridge as defined in claim 26 wherein said violin bridge is made of spotted maple wood.

30. An improved violin bridge as defined in claim 26 wherein said violin bridge is made of polycarbonate which contains approximately thirty percent (30%) fiberglass.

31. An improved violin bridge as defined in claim 26 wherein said violin bridge is made of plastic material and formed through injection molding.

32. An improved violin bridge of the type characterized by a generally wedge shaped member having a pair of protruding feet on the corners of its thicker bottom end and having its thinner top end convexly curved across its width, and further having a first side and a second side, wherein the improved violin bridge for a one sixteenth size violin comprises:

a. a generally heart shaped opening with its pointed end extending downwardly, comprising a first side, a second side, an upper end, and a lower pointed end, located at the central widthwise portion of said violin bridge;

b. a first generally oval shaped opening which has an inner edge spaced apart from said first side of said generally heart shaped opening, and an upper edge, being located to one side of said generally heart shaped opening;

c. a first lower edge opening extending from said inner edge of said first generally oval shaped opening, comprising a downwardly and outwardly extending section which extends into an upwardly and outwardly extending section which terminates at the first edge of said violin bridge;

d. a second generally oval shaped opening which has an inner edge spaced apart from said second side of said generally heart shaped opening, and an upper edge, being located on the side of said violin bridge opposite said first generally oval shaped opening;

e. a second lower edge opening extending from said inner edge of said second generally oval shaped opening, comprising a downwardly and outwardly extending section which extends into an upwardly and outwardly extending section which terminates at the second edge of said violin bridge;

f. the upper edge of said first generally oval shaped opening, the upper end of said generally heart shaped opening, and the upper edge of said second generally oval shaped opening forming a curve which is substantially parallel to the curve of the upper end of said violin bridge;

g. the distance between the curve formed by the upper edge of said first generally oval shaped opening, the upper end of said generally heart shaped opening, and the upper edge of said second generally oval shaped opening, and the curve of the upper end of said violin bridge being sufficient to allow a substantial unopened amount of bridge material therebetween;

h. an elongated widthwise opening containing a convexly downwardly curved upper edge located between said two feet of said violin bridge;

i. said elongated widthwise opening further comprising a first upper end and a second upper end located at the opposite sides of its convexly curved upper edge;

j. the nearest distance between said inner edge of said first generally oval shaped opening and said first side of said generally heart shaped opening being approximately three millimeters;

k. the nearest distance between said inner edge of the second generally oval shaped opening and said second side of said generally heart shaped opening being approximately three millimeters;

l. the nearest distance between the approximate lower edge central point of the downwardly and outwardly extending section of said first lower edge opening and first upper end of said elongated widthwise opening being approximately three millimeters;

m. the nearest distance between the approximate lower edge central point of the downwardly and outwardly extending section of said second lower edge opening and the second upper end of said elongated widthwise opening being approximately three millimeters; and n. the vertical distance between the lower pointed end of said generally heart shaped opening and the approximate central point of said convexly curved upper edge of said elongated widthwise opening being approximately four millimeters;

o. whereby the openings and cricital distances between the opening enables said violin bridge to have substantially increased flexibility in order to significantly amplify the vibrations set up on the bowed strings of the violin and significantly improve the transmission of the vibrations from the bowed strings to the sounding box of the violin on which said violin bridge rests, and wherein the substantial amount of unopened bridge material above the curve formed by the upper edge of said first generally oval shaped opening, the upper end of said generally heart shaped opening, and the upper edge of said second generally oval shaped opening allows the bridge to be modified by removing desired amounts of material from its upper end to provide a desired elevation at which the violin strings are supported above the belly of the violin without detracting from the sound amplification and transmission ability of the violin bridge.

33. An improved violin bridge as defined in claim 32 wherein said elongated widthwise opening located between said two feet is approximately eighteen millimeters.

34. An improved violin bridge as defined in claim 32 wherein the thickness of the bottom of said violin bridge is approximately three and one-half millimeters and the thickness of the top end of said violin bridge is approximately one and two-tenths millimeters.

35. An improved violin bridge as defined in claim 32 wherein said violin bridge is made of spotted maple wood.

36. An improved violin bridge as defined in claim 32 wherein said violin bridge is made of polycarbonate which contains approximately thirty percent (30%) fiberglass.

37. An improved violin bridge as defined in claim 32 wherein said violin bridge is made of plastic material and formed through injection molding.

38. An improved viola bridge of the type characterized by a generally wedge shaped member having a pair of protruding feet on the corners of its thicker bottom end and having its thinner top end convexly curved across its width, and further having a first side and a second side, wherein the improved viola bridge for a standard 4—4 size viola comprises:

a. a generally heart shaped opening with its pointed end extending downwardly, comprising a first side, a second side, an upper end, and a lower pointed end, located at the central widthwise portion of said viola bridge;

b. a first generally oval shaped opening which has an inner edge spaced apart from said first side of said generally heart shaped opening, and an upper edge, being located to one side of said generally heart shaped opening;

c. a first lower edge opening extending from said inner edge of said first generally oval shaped opening, comprising a downwardly and outwardly extending section which extends into an upwardly and outwardly extending section which terminates at the first edge of said viola bridge;

d. a second generally oval shaped opening which has an inner edge spaced apart from said second side of said generally heart shaped opening, and an upper edge, being located on the side of said viola bridge opposite said first generally oval shaped opening;

e. a second lower edge opening extending from said inner edge of said second generally oval shaped opening, comprising a downwardly and outwardly extending section which extends into an upwardly and outwardly extending section which terminates at the second edge of said viola bridge;

f. the upper edge of said first generally oval shaped opening, the upper end of said generally heart shaped opening, and the upper edge of said second generally oval shaped opening forming a curve which is substantially parallel to the curve of the upper end of said viola bridge;

g. the distance between the curve formed by the upper edge of said first generally oval shaped opening, the upper end of said generally heart shaped opening, and the upper edge of said second generally oval shaped opening, and the curve of the upper end of said viola bridge being sufficient to allow a substantial unopened amount of bridge material therebetween;

h. an elongated widthwise opening containing a convexly downwardly curved upper edge located between said two feet of said viola bridge;

i. said elongated widthwise opening further comprising a first upper end and a second upper end located at the opposite sides of its convexly curved upper edge;

j. the nearest distance between said inner edge of said first generally oval shaped opening and said first side of said generally heart shaped opening being approximately six millimeters;

k. the nearest distance between said inner edge of the second generally oval shaped opening and said second side of said generally heart shaped opening being approximately six millimeters;

l. the nearest distance between the approximate lower edge central point of the downwardly and outwardly extending section of said first lower edge opening and first upper end of said elongated widthwise opening being approximately six millimeters;

m. the nearest distance between the approximate lower edge central point of the downwardly and outwardly extending section of said second lower edge opening and the second upper end of said elongated widthwise opening being approximately six millimeters; and n. the vertical distance between the lower pointed end of said generally heart shaped opening and the approximate central point of said convexly curved upper edge of said elongated widthwise opening being approximately nine millimeters;

o. whereby the openings and cricital distances between the opening enables said viola bridge to have substantially increased flexibility in order to significantly amplify the vibrations set up on the bowed strings of the violin and significantly improve the transmission of the vibrations from the bowed strings to the sounding box of the viola on which said viola bridge rests, and wherein the substantial amount of unopened bridge material above the curve formed by the upper edge of said first generally oval shaped opening, the upper end of said generally heart shaped opening, and the upper edge of said second generally oval shaped opening allows the bridge to be modified by removing desired amounts of material from its upper end to provide a desired elevation at which the violin strings are supported above the belly of the viola without detracting from the sound amplification and transmission ability of the viola bridge.

39. An improved viola bridge as defined in claim 38 wherein said elongated widthwise opening located between said two feet is approximately twenty-eight millimeters.

40. An improved viola bridge as defined in claim 38 wherein the thickness of the bottom of said viola bridge is approximately six and one-half millimeters and the thickness of the top end of said viola bridge is approximately two millimeters.

41. An improved viola bridge as defined in claim 38 wherein said viola bridge is made of spotted maple wood.

42. An improved viola bridge as defined in claim 38 wherein said viola bridge is made of polycarbonate which contains approximately thirty percent (30%) fiberglass.

43. An improved viola bridge as defined in claim 38 wherein said viola bridge is made of plastic material and formed through injection molding.

44. An improved violin bridge which is capable of being modified to provide a desired elevation at which the violin strings are supported above the belly of the instrument and which has significant flexibility to substantially amplify the transmission of sounds from the bowed strings to the sounding box of the violin, the improved violin bridge for a standard 4-4 size violin comprising:

a. an integrally formed member adapted to extend transversely underneath the violin strings, having a tapered cross-sectional configuration which is thicker at its bottom end;

b. the outer edges of the bottom end of the violin bridge having protruding feet for supporting the violin bridge on the belly of the violin;

c. the top end of the violin bridge being convexly curved in an upward direction across its width for supporting the violin strings;

d. the violin bridge being further characterized by the fact that its bottom surface between said feet is slightly convexly downwardly curved;

e. the body of the violin bridge having a set of three openings therethrough for improving the structural flexibility of the bridge so as to provide the desired sound transmitting and amplifying capabilities;

f. the upper extremities of said three openings together defining a curve which is substantially parallel to the curved top end of the bridge;

g. two of said openings being at the lateral edges of the violin bridge and located a short distance above the corresponding feet;

h. the third opening centrally located in said bridge and of a generally heart shaped configuration with its pointed end extending downwardly;

i. the approximate nearest distance between each of the openings at the lateral edges and said central heart shaped opening being four millimeters;

j. the approximate nearest distance between each of the openings at the lateral edges and the slightly convexly downwardly curved bottom surface being five and one-half millimeters;

k. the approximate nearest distance between the pointed end of the generally heart shaped opening and the slightly convexly downwardly curved bottom surface being seven millimeters.

45. An improved violin bridge as defined in claim 44 wherein the thickness of the bottom of said violin bridge is approximately five and one-half millimeters and the thickness of the top of said violin bridge is approximately one and three-quarters millimeters.

46. An improved violin bridge as defined in claim 44 wherein said violin bridge is made of spotted maple wood.

47. An improved violin bridge as defined in claim 44 wherein said violin bridge is made of polycarbonate which contains approximately thirty percent (30%) fiberglass.

48. An improved violin bridge as defined in claim 44 wherein said violin bridge is made of plastic material and formed through injection molding.

49. An improved violin bridge which is capable of being modified to provide a desired elevation at which the violin strings are supported above the belly of the instrument and which has significant flexibility to substantially amplify the transmission of sounds from the bowed strings to the sounding box of the violin, the improved violin bridge for a three-quarter size violin comprising:

a. an integrally formed member adapted to extend transversely underneath the violin strings, having a tapered cross-sectional configuration which is thicker at its bottom end;
b. the outer edges of the bottom end of the violin bridge having protruding feet for supporting the violin bridge on the belly of the violin;
c. the top end of the violin bridge being convexly curved in an upward direction across its width for supporting the violin strings;
d. the violin bridge being further characterized by the fact that its bottom surface between said feet is slightly convexly downwardly curved;
e. the body of the violin bridge having a set of three openings therethrough for improving the structural flexibility of the bridge so as to provide the desired sound transmitting and amplifying capabilities;
f. the upper extremities of said three openings together defining a curve which is substantially parallel to the curved top end of the bridge;
g. two of said openings being at the lateral edges of the violin bridge and located a short distance above the corresponding feet;
h. the third opening centrally located in said bridge and of a generally heart shaped configuration with its pointed end extending downwardly;
i. the approximate nearest distance between each of the openings at the lateral edges and said central heart shaped opening being four millimeters;
j. the approximate nearest distance between each of the openings at the lateral edges and the slightly convexly downwardly curved bottom surface being five millimeters;
k. the approximate nearest distance between the pointed end of the generally heart shaped opening and the slightly convexly downwardly curved bottom surface being six millimeters.

50. An improved violin bridge as defined in claim 49 wherein the thickness of the bottom of said violin bridge is approximately five millimeters and the thickness of the top of said violin bridge is approximately one and seven-tenths millimeters.

51. An improved violin bridge as defined in claim 49 wherein said violin bridge is made of spotted maple wood.

52. An improved violin bridge as defined in claim 49 wherein said violin bridge is made of polycarbonate which contains approximately thirty percent (30%) fiberglass.

53. An improved violin bridge as defined in claim 49 wherein said violin bridge is made of plastic material and formed through injection molding.

54. An improved violin bridge which is capable of being modified to provide a desired elevation at which the violin strings are supported above the belly of the instrument and which has significant flexibility to substantially amplify the transmission of sounds from the bowed strings to the sounding box of the violin, the improved violin bridge for a one-half size violin comprising:

a. an integrally formed member adapted to extend transversely underneath the violin strings, having a tapered cross-sectional configuration which is thicker at its bottom end;
b. the outer edges of the bottom end of the violin bridge having protruding feet for supporting the violin bridge on the belly of the violin;
c. the top end of the violin bridge being convexly curved in an upward direction across its width for supporting the violin strings;
d. the violin bridge being further characterized by the fact that its bottom surface between said feet is slightly convexly downwardly curved;
e. the body of the violin bridge having a set of three openings therethrough for improving the structural flexibility of the bridge so as to provide the desired sound transmitting and amplifying capabilities;
f. the upper extremities of said three openings together defining a curve which is substantially parallel to the curved top end of the bridge;
g. two of said openings being at the lateral edges of the violin bridge and located a short distance above the corresponding feet;
h. the third opening centrally located in said bridge and of a generally heart shaped configuration with its pointed end extending downwardly;
i. the approximate nearest distance between each of the openings at the lateral edges and said central heart shaped opening being four millimeters;
j. the approximate nearest distance between each of the openings at the lateral edges and the slightly convexly downwardly curved bottom surface being four millimeters;
k. the approximate nearest distance between the pointed end of the generally heart shaped opening and the slightly convexly downwardly curved bottom surface being five millimeters.

55. An improved violin bridge as defined in claim 54 wherein the thickness of the bottom of said violin bridge is approximately four and one-half millimeters and the thickness of the top of said violin bridge is approximately one and one-half millimeters.

56. An improved violin bridge as defined in claim 54 wherein said violin bridge is made of spotted maple wood.

57. An improved violin bridge as defined in claim 54 wherein said violin bridge is made of polycarbonate which contains approximately thirty percent (30) fiberglass.

58. An improved violin bridge as defined in claim 54 wherein said violin bridge is made of plastic material and formed through injection molding.

59. An improved violin bridge which is capable of being modified to provide a desired elevation at which the violin strings are supported above the belly of the instrument and which has significant flexibility to substantially amplify the transmission of sounds from the bowed strings to the sounding box of the violin, the improved violin bridge for a one-quarter size violin comprising:

a. an integrally formed member adapted to extend transversely underneath the violin strings, having a tapered cross-sectional configuration which is thicker at its bottom end;
b. the outer edges of the bottom end of the violin bridge having protruding feet for supporting the violin bridge on the belly of the violin;
c. the top end of the violin bridge being convexly curved in an upward direction across its width for supporting the violin strings;
d. the violin bridge being further characterized by the fact that its bottom surface between said feet is slightly convexly downwardly curved;
e. the body of the violin bridge having a set of three openings therethrough for improving the structural flexibility of the bridge so as to provide the desired sound transmitting and amplifying capabilities;
f. the upper extremities of said three openings together defining a curve which is substantially parallel to the curved top end of the bridge;
g. two of said openings being at the lateral edges of the violin bridge and located a short distance above the corresponding feet;
h. the third opening centrally located in said bridge and of a generally heart shaped configuration with its pointed end extending downwardly;
i. the approximate nearest distance between each of the openings at the lateral edges and said central heart shaped opening being four millimeters;
j. the approximate nearest distance between each of the openings at the lateral edges and the slightly convexly downwardly curved bottom surface being four millimeters;
k. the approximate nearest distance between the pointed end of the generally heart shaped opening and the slightly convexly downwardly curved bottom surface being five millimeters.

60. An improved violin bridge as defined in claim 59 wherein the thickness of the bottom of said violin bridge is approximately four millimeters and the thickness of the top of said violin bridge is approximately one and four-tenths millimeters.

61. An improved violin bridge as defined in claim 59 wherein said violin bridge is made of spotted maple wood.

62. An improved violin bridge as defined in claim 59 wherein said violin bridge is made of polycarbonate which contains approximately thirty percent (30%) fiberglass.

63. An improved violin bridge as defined in claim 59 wherein said violin bridge is made of plastic material and formed through injection molding.

64. An improved violin bridge which is capable of being modified to provide a desired elevation at which the violin strings are supported above the belly of the instrument and which has significant flexibility to substantially amplify the transmission of sounds from the bowed strings to the sounding box of the violin, the improved violin bridge for a one eighth size violin comprising:

a. an integrally formed member adapted to extend transversely underneath the violin strings, having a tapered cross-sectional configuration which is thicker at its bottom end;
b. the outer edges of the bottom end of the violin bridge having protruding feet for supporting the violin bridge on the belly of the violin;
c. the top end of the violin bridge being convexly curved in an upward direction across its width for supporting the violin strings;
d. the violin bridge being further characterized by the fact that its bottom surface between said feet is slightly convexly downwardly curved;
e. the body of the violin bridge having a set of three openings therethrough for improving the structural flexibility of the bridge so as to provide the desired sound transmitting and amplifying capabilities;
f. the upper extremities of said three openings together defining a curve which is substantially parallel to the curved top end of the bridge;
g. two of said openings being at the lateral edges of the violin bridge and located a short distance above the corresponding feet;
h. the third opening centrally located in said bridge and of a generally heart shaped configuration with its pointed end extending downwardly;
i. the approximate nearest distance between each of the openings at the lateral edges and said central heart shaped opening being three millimeters;
j. the approximate nearest distance between each of the openings at the lateral edges and the slightly convexly downwardly curved bottom surface being three millimeters;
k. the approximate nearest distance between the pointed end of the generally heart shaped opening and the slightly convexly downwardly curved bottom surface being four millimeters.

65. An improved violin bridge as defined in claim 64 wherein the thickness of the bottom of said violin bridge is approximately three and one-half millimeters and the thickness of the top of said violin bridge is approximately one and three-tenth millimeters.

66. An improved violin bridge as defined in claim 64 wherein said violin bridge is made of spotted maple wood.

67. An improved violin bridge as defined in claim 64 wherein said violin bridge is made of polycarbonate which contains approximately thirty percent (30%) fiberglass.

68. An improved violin bridge as defined in claim 64 wherein said violin bridge is made of plastic material and formed through injection molding.

69. An improved violin bridge which is capable of being modified to provide a desired elevation at which the violin strings are supported above the belly of the instrument and which has significant flexibility to substantially amplify the transmission of sounds from the bowed strings to the sounding box of the violin, the improved violin bridge for a one-sixteenth size violin comprising:

a. an integrally formed member adapted to extend transversely underneath the violin strings, having a tapered cross-sectional configuration which is thicker at its bottom end;

b. the outer edges of the bottom end of the violin bridge having protruding feet for supporting the violin bridge on the belly of the violin;

c. the top end of the violin bridge being convexly curved in an upward direction across its width for supporting the violin strings;

d. the violin bridge being further characterized by the fact that its bottom surface between said feet is slightly convexly downwardly curved;

e. the body of the violin bridge having a set of three openings therethrough for improving the structural flexibility of the bridge so as to provide the desired sound transmitting and amplifying capabilities;

f. the upper extremities of said three openings together defining a curve which is substantially parallel to the curved top end of the bridge;

g. two of said openings being at the lateral edges of the violin bridge and located a short distance above the corresponding feet;

h. the third opening centrally located in said bridge and of a generally heart shaped configuration with its pointed end extending downwardly;

i. the approximate nearest distance between each of the openings at the lateral edges and said central heart shaped opening being three millimeters;

j. the approximate nearest distance between each of the openings at the lateral edges and the slightly convexly downwardly curved bottom surface being three millimeters;

k. the approximate nearest distance between the pointed end of the generally heart shaped opening and the slightly convexly downwardly curved bottom surface being four millimeters.

70. An improved violin bridge as defined in claim 69 wherein the thickness of the bottom of said violin bridge is approximately three and one half millimeters and the thickness of the top of said violin bridge is approximately one and two-tenths millimeters.

71. An improved violin bridge as defined in claim 69 wherein said violin bridge is made of spotted maple wood.

72. An improved violin bridge as defined in claim 69 wherein said violin bridge is made of polycarbonate which contains approximately thirty percent (30%) fiberglass.

73. An improved violin bridge as defined in claim 69 wherein said violin bridge is made of plastic material and formed through injection molding.

74. An improved viola bridge which is capable of being modified to provide a desired elevation at which the viola strings are supported above the belly of the instrument and which has significant flexibility to substantially amplify the transmission of sounds from the bowed strings to the sounding box of the viola, the improved viola bridge for a standard 4-4 size viola comprising:

a. an integrally formed member adapted to extend transversely underneath the viola strings, having a tapered cross-sectional configuration which is thicker at its bottom end;

b. the outer edges of the bottom end of the viola bridge having protruding feet for supporting the viola bridge on the belly of the viola;

c. the top end of the viola bridge being convexly curved in an upward direction across its width for supporting the viola strings;

d. the viola bridge being further characterized by the fact that its bottom surface between said feet is slightly convexly downwardly curved;

e. the body of the viola bridge having a set of three openings therethrough for improving the structural flexibility of the bridge so as to provide the desired sound transmitting and amplifying capabilities;

f. the upper extremities of said three openings together defining a curve which is substantially parallel to the curved top end of the bridge;

g. two of said openings being at the lateral edges of the viola bridge and located a short distance above the corresponding feet;

h. the third opening centrally located in said bridge and of a generally heart shaped configuration with its pointed end extending downwardly;

i. the approximate nearest distance between each of the openings at the later edges and said central heart shaped opening being six millimeters;

j. the approximate nearest distance between each of the openings at the lateral edges and the slightly convexly downwardly curved bottom surface being six millimeters;

k. the approximate nearest distance between the pointed end of the generally heart shaped opening and the slightly convexly downwardly curved bottom surface being nine millimeters.

75. An improved viola bridge as defined in claim 74 wherein the thickness of the bottom of said viola bridge is approximately six and one-half and the thickness of the top of said viola bridge is approximately two millimeters.

76. An improved viola bridge as defined in claim 74 wherein said viola bridge is made of spotted maple wood.

77. An improved viola bridge as defined in claim 74 wherein said viola bridge is made of polycarbonate which contains approximately thirty percent (30%) fiberglass.

78. An improved viola bridge as defined in claim 74 wherein said viola bridge is made of plastic material and formed through injection molding.

79. An improved bridge for a viola of the type comprising an integrally formed member adapted to rest upon the belly of the viola and extend transversely beneath the strings with a convexly curved upper surface for supporting the strings, characterized in that it has as central opening and a pair of lateral edge openings for increasing its flexibility and hence sound transmitting and amplifying capability with the upper boundary of the three openings lying along a curved path that is substantially parallel to the curved upper end of said bridge and further characterized in that its bottom end has feet on its lateral edges with a bottom channel therebetween, the upper extremity of the channel being formed by a slightly downwardly convex surface of the bridge.

* * * * *